US009693672B2

(12) United States Patent
Feddema

(10) Patent No.: US 9,693,672 B2
(45) **Date of Patent: *Jul. 4, 2017**

(54) DISHWASHER WITH SPRAYER

(75) Inventor: Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1139 days.

This patent is subject to a terminal disclaimer.

(21) Appl. No.: 13/570,577

(22) Filed: Aug. 9, 2012

(65) Prior Publication Data

US 2013/0074887 A1 Mar. 28, 2013

Related U.S. Application Data

(60) Provisional application No. 61/537,595, filed on Sep. 22, 2011.

(51) Int. Cl.
*A47L 15/42* (2006.01)
*A47L 15/23* (2006.01)

(52) U.S. Cl.
CPC ..... *A47L 15/4282* (2013.01); *A47L 15/23* (2013.01)

(58) Field of Classification Search
CPC ..... A47L 15/4282; A47L 15/22; A47L 15/23; A47L 15/4221; A47L 15/18; A47L 15/20
See application file for complete search history.

(56) References Cited

U.S. PATENT DOCUMENTS 1,966,572 A * 7/1934 Webb ..... A47L 15/16 134/200
1,997,450 A 4/1935 Burkle
3,009,648 A * 11/1961 Hait ..... B05B 1/265 239/201
3,064,664 A 11/1962 Warhus
3,064,665 A * 11/1962 Martiniak ..... A47L 15/23 134/144
3,146,953 A 9/1964 Komanns
3,160,164 A 12/1964 Constance et al.
3,253,784 A 5/1966 Long et al.
3,598,130 A * 8/1971 Nolte ..... A47L 15/0081 134/102.1

(Continued)

FOREIGN PATENT DOCUMENTS

DE 7024995 U 6/1970
DE 4036930 A1 5/1992

(Continued)

OTHER PUBLICATIONS

EP1334687—Machine Translation, Aug. 2003.*

(Continued)

*Primary Examiner* — Michael Kornakov
*Assistant Examiner* — Marc Lorenzi
(74) *Attorney, Agent, or Firm* — McGarry Bair PC

(57) ABSTRACT

A dishwasher includes a tub at least partially defining a treating chamber and a sprayer for spraying liquid to the treating chamber. The sprayer may include a liquid passage and at least one outlet extending from an interior to an exterior of the sprayer and in fluid communication with the liquid passage. A membrane may have at least one opening and may be in fluid communication with the liquid passage to control the flow of liquid through the at least one outlet.

17 Claims, 10 Drawing Sheets

(56) References Cited

U.S. PATENT DOCUMENTS

| | | | | |
|---|---|---|---|---|
| 3,709,236 | A | 1/1973 | Field et al. | |
| 3,771,725 | A | 11/1973 | Jenkins et al. | |
| 3,797,509 | A | 3/1974 | Fukuzawa et al. | |
| 3,918,644 | A | 11/1975 | Platt et al. | |
| 4,266,565 | A | 5/1981 | Gurubatham | |
| 4,509,687 | A | 4/1985 | Cushing | |
| 4,993,444 | A * | 2/1991 | Toriyama | A47L 15/18 134/181 |
| 5,331,986 | A | 7/1994 | Lim et al. | |
| 5,415,350 | A | 5/1995 | Yoon et al. | |
| 5,427,129 | A | 6/1995 | Young, Jr. et al. | |
| 2,726,666 | A | 12/1995 | Oxford | |
| 5,546,968 | A | 8/1996 | Jeon et al. | |
| 5,577,665 | A | 11/1996 | Chang | |
| 5,601,100 | A | 2/1997 | Kawakami et al. | |
| 5,609,174 | A | 3/1997 | Ferguson | |
| 5,655,556 | A | 8/1997 | Guerrera et al. | |
| 5,662,744 | A | 9/1997 | Tuller et al. | |
| 5,673,714 | A | 10/1997 | Campagnolo et al. | |
| 5,697,392 | A | 12/1997 | Johnson et al. | |
| 5,944,037 | A | 8/1999 | Sinyong et al. | |
| 5,964,232 | A | 10/1999 | Chung | |
| 6,053,185 | A | 4/2000 | Beevers | |
| 6,325,083 | B1 | 12/2001 | Worter | |
| 6,692,093 | B1 * | 2/2004 | Park | F16M 11/10 312/319.7 |
| 7,314,188 | B2 | 1/2008 | Watson et al. | |
| 7,331,356 | B2 | 2/2008 | VanderRoest et al. | |
| 7,445,013 | B2 | 11/2008 | Vanderroest et al. | |
| 7,475,696 | B2 | 1/2009 | Vanderroest et al. | |
| 7,493,907 | B2 | 2/2009 | Roh | |
| 7,523,758 | B2 | 4/2009 | Vanderroest et al. | |
| 7,594,513 | B2 | 9/2009 | VanderRoest et al. | |
| 7,673,639 | B2 | 3/2010 | Shin | |
| 7,810,512 | B2 | 10/2010 | Pyo et al. | |
| 7,896,977 | B2 | 3/2011 | Gillum et al. | |
| 7,935,194 | B2 | 5/2011 | Rolek | |
| 7,959,744 | B2 | 6/2011 | Sundaram et al. | |
| 7,980,260 | B2 | 7/2011 | Bertsch et al. | |
| 8,113,222 | B2 | 2/2012 | Bertsch et al. | |
| 8,137,479 | B2 | 3/2012 | Vanderroest et al. | |
| 8,187,390 | B2 | 5/2012 | Vanderroest et al. | |
| 8,210,191 | B2 | 7/2012 | Gnadinger et al. | |
| 8,282,741 | B2 | 10/2012 | Bertsch et al. | |
| 2006/0108454 | A1 * | 5/2006 | Eichholz | A47L 15/16 239/562 |
| 2006/0278258 | A1 | 12/2006 | Kara et al. | |
| 2007/0056613 | A1 | 3/2007 | Haas et al. | |
| 2007/0289615 | A1 | 12/2007 | Shin | |
| 2009/0071508 | A1 * | 3/2009 | Sundaram | A47L 15/18 134/18 |
| 2009/0101182 | A1 | 4/2009 | Buesing et al. | |
| 2009/0101185 | A1 | 4/2009 | Pardini | |
| 2009/0159103 | A1 | 6/2009 | Gillum et al. | |
| 2010/0108102 | A1 | 5/2010 | Kehl et al. | |
| 2010/0139719 | A1 | 6/2010 | Gnadinger et al. | |
| 2011/0030742 | A1 | 2/2011 | Dalsing et al. | |
| 2011/0203619 | A1 | 8/2011 | Kara et al. | |
| 2011/0284039 | A1 * | 11/2011 | Christie | E03D 9/00 134/167 C |
| 2011/0303250 | A1 | 12/2011 | Delgado et al. | |
| 2012/0279530 | A1 | 11/2012 | Thiyagarajan | |
| 2012/0279536 | A1 | 11/2012 | Adams et al. | |
| 2013/0074886 | A1 | 3/2013 | Feddema et al. | |
| 2013/0074888 | A1 | 3/2013 | Feddema | |
| 2013/0074890 | A1 | 3/2013 | Feddema et al. | |
| 2014/0054395 | A1 | 2/2014 | Heisele et al. | |
| 2014/0332041 | A1 | 11/2014 | Feddema | |

FOREIGN PATENT DOCUMENTS

| | | | |
|---|---|---|---|
| DE | 102005026558 | B3 | 11/2006 |
| DE | 102010043019 | A1 | 5/2012 |
| DE | 102011053666 | A1 | 5/2012 |
| EP | 0524102 | A1 | 1/1993 |
| EP | 0764421 | B1 | 3/1997 |
| EP | 0795292 | A2 | 9/1997 |
| EP | 0943281 | A2 | 9/1999 |
| EP | 0943282 | A2 | 9/1999 |
| EP | 1040786 | A1 | 10/2000 |
| EP | 1040787 | A1 | 10/2000 |
| EP | 1252856 | A2 | 10/2002 |
| EP | 1277430 | A1 | 1/2003 |
| EP | 1334687 | B2 | 8/2003 |
| EP | 2292134 | A1 | 3/2011 |
| EP | 2572624 | A1 | 3/2013 |
| GB | 2019204 | A | 10/1979 |
| GB | 2199734 | A | 7/1988 |
| GB | 2215990 | A | 10/1989 |
| JP | 60053120 | | 3/1985 |
| JP | 4033632 | A | 2/1992 |
| JP | 5184514 | A | 7/1993 |
| JP | 8089467 | A | 4/1996 |
| JP | 9164107 | A | 6/1997 |
| JP | 10243910 | A | 9/1998 |
| JP | 11019019 | A | 1/1999 |
| JP | 11076127 | A | 3/1999 |
| JP | 2004113683 | A | 4/2004 |
| KR | 200156558 | Y1 | 9/1999 |
| KR | 20060029567 | A | 4/2006 |
| KR | 20090037299 | A | 4/2009 |
| WO | 2010012703 | A2 | 2/2010 |
| WO | 2011144540 | A2 | 11/2011 |
| WO | 2011154471 | A1 | 12/2011 |
| WO | 2012065873 | A2 | 5/2012 |

OTHER PUBLICATIONS

European Search Report for Corresponding EP 12185512.6, December 6, 2012.

European Search Report for Corresponding EP14177086.7, Oct. 20, 2014.

European Search Report for Corresponding EP14155441.0, May 30, 2014.

European Search Report for Corresponding EP14155444.4, May 6, 2014.

German Search Report for Counterpart DE102013111241.2, May 23, 2014.

European Search Report for Corresponding EP 12185514.2, Dec. 6, 2012.

European Search Report for Corresponding EP 12185510.0, Dec. 19, 2012.

* cited by examiner

DISHWASHER WITH SPRAYER

CROSS-REFERENCE TO RELATED APPLICATIONS

This application claims of the benefit of U.S. Provisional Patent Application No. 61/537,595, filed Sep. 22, 2011, which is incorporated herein by reference in its entirety.

BACKGROUND OF THE INVENTION

Contemporary automatic dishwashers for use in a typical household include a tub and at least one rack or basket for supporting soiled utensils within the tub. A spraying system may be provided for recirculating liquid throughout the tub to remove soils from the utensils. The spraying system may include various sprayers including a rotatable spray arm.

SUMMARY

An embodiment of the invention relates to a dishwasher having a tub at least partially defining a treating chamber and a sprayer for spraying liquid into the treating chamber and defining an interior having at least one liquid passage, and at least one outlet extending from the interior to an exterior of the sprayer and in fluid communication with the liquid passage and a membrane having at least one opening, and in fluid communication with the liquid passage. The membrane and the sprayer are coupled for relative movement such that the opening passes over at least a portion of the at least one outlet to fluidly couple the liquid passage to the outlet and provide for the flow of liquid from the liquid passage, through the opening, and through the outlet to emit a spray of liquid from the sprayer into the treating chamber.

DESCRIPTION OF EMBODIMENTS OF THE INVENTION

Figure 1:
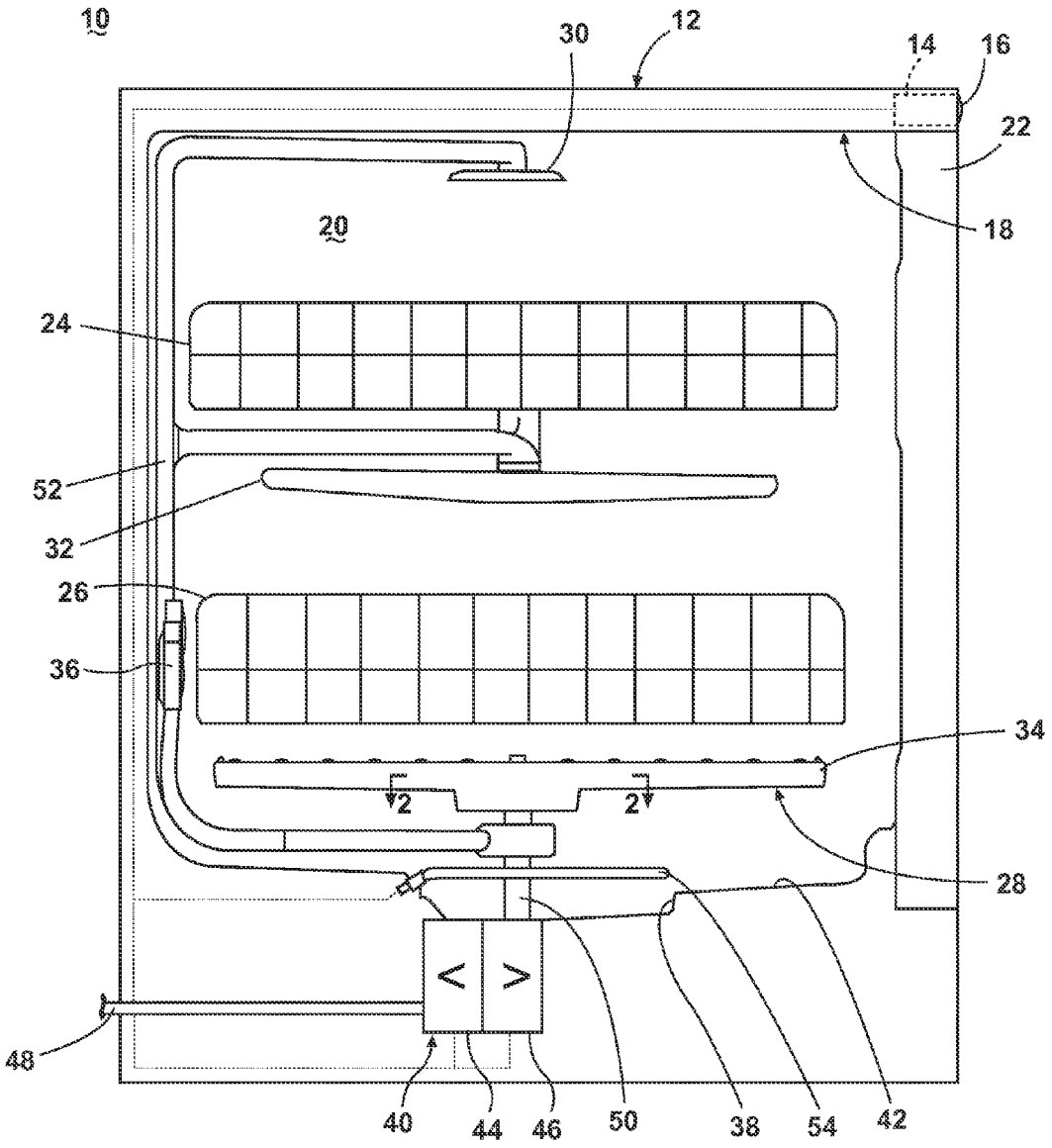
FIG. 1 is a schematic view of a dishwasher with a spray system according to a first embodiment of the invention.

Referring to FIG. 1, a first embodiment of the invention is illustrated as an automatic dishwasher 10 having a cabinet

12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any utensils positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
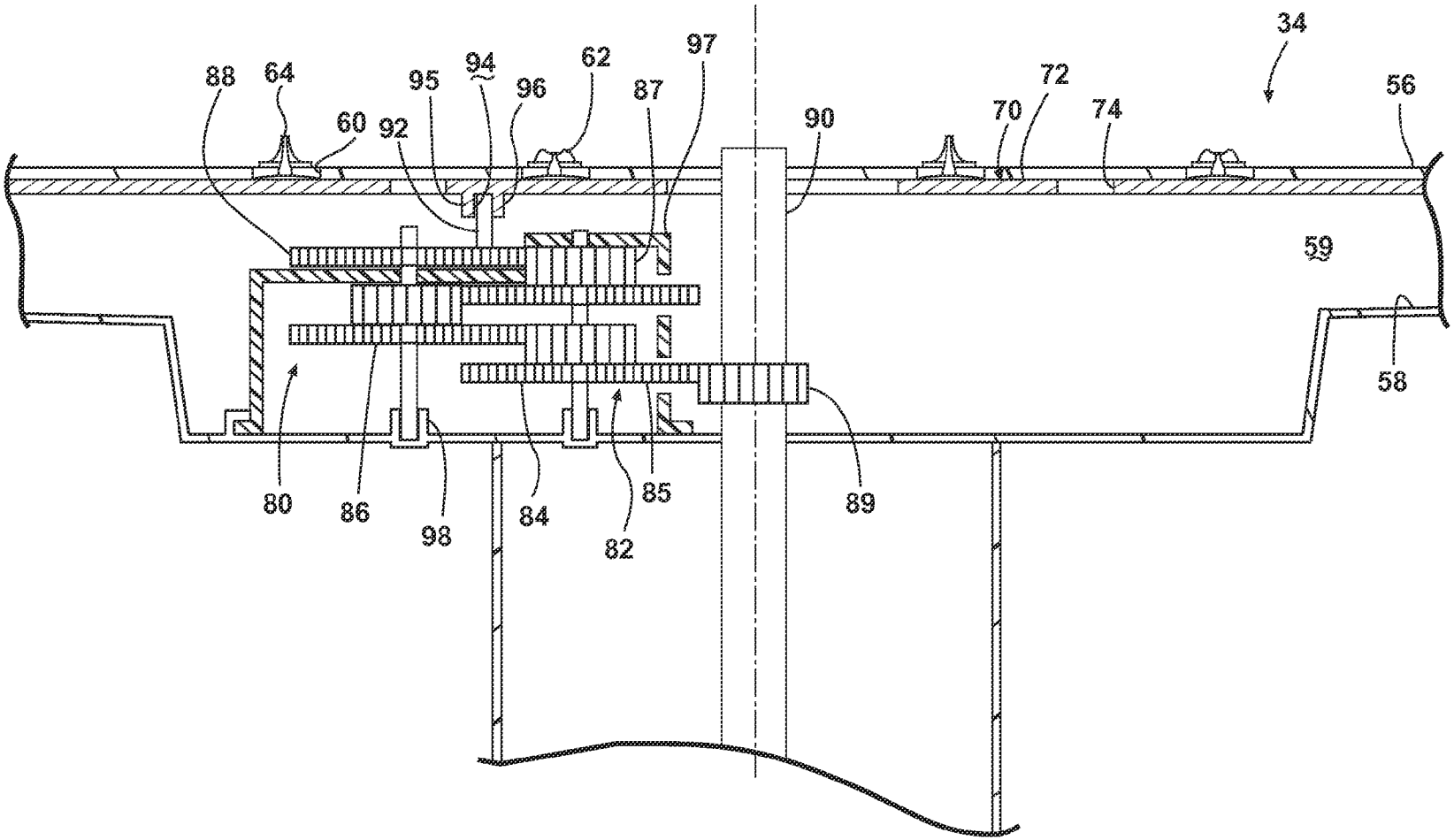
FIG. 2 is a cross-sectional view of a rotatable spray arm of the spray system of the dishwasher of FIG. 1 and illustrating a valve body for the rotatable spray arm.

FIG. 2 illustrates a cross-sectional view of the lower rotatable spray arm 34 comprising a body 56 having an interior 58. A liquid passage 59 may be provided in the interior 58 and fluidly couples with the outlet conduit 50 and recirculation pump 46. A plurality of outlets 60 extend through the body 56 and may be in fluid communication with the liquid passage 59. As illustrated, the interior 58 defines the liquid passage 59. However, a separate liquid passage 59 may be located within the interior 58.

Nozzles, such as nozzles 62 and 64, may be provided on the body 56 and may be fluidly coupled with the outlets 60, which lead to the liquid passage 59. Multiple nozzles 62 and 64 have been illustrated. The multiple nozzles 62 may correlate to a first subset of the plurality of outlets 60 and the multiple nozzles 64 may correlate to a second subset of the plurality of outlets 60. Nozzles 62 and 64 may provide different spray patterns, although this need not be the case. It is advantageous to do so to provide for different cleaning effects from a single spray arm. The first nozzle 62 may emit a first spray pattern (not shown), which may be a discrete, focused, and concentrated spray, which may provide a higher pressure spray. The second nozzle 64 may emit a second spray pattern (not shown), which may be a wide angle diffused spray pattern that produces more of a shower as compared to the more concentrated and discrete spray pattern produced by the first nozzle 62. The shower spray may be more suitable for distributing treating chemistry whereas the higher pressure spray may be more suitable for dislodging soils. It has been contemplated that the nozzles 62 and 64 may be arranged differently such that each type of nozzle 62, 64 may be included in both the first and second subsets of outlets 60.

A valve body 70 is illustrated as being located within the interior 58 and may be operable to selectively fluidly couple at least some of the plurality of outlets 60 to the liquid passage 59. The valve body 70 may be reciprocally moveable within the body 56. More specifically, the valve body 70 has been illustrated as including a slidable plate 72 having multiple openings 74. The slidable plate 72 may be slidably mounted within the interior 58 of the body 56 of the rotatable spray arm 34 for movement between at least two positions. One position may allow the multiple openings 74 to fluidly couple the first subset of outlets 60 to the liquid passage 59 and the second position may allow the multiple openings 74 to fluidly couple the second subset of outlets 60 to the liquid passage 59. In this way, the different nozzles 62, 64 and/or different spray patterns may be selected with the sliding of the plate 72. Alternatively, the different subsets of outlets 60 may be located on different portions of the arms such that the selection of a particular subset of outlets 60 controls the location of the spray, regardless of whether the spray pattern is different. For example, one subset of outlets 60 may be located at the ends of the spray arm to direct liquid solely into the hard to reach areas of the treating chamber.

An actuator 80 may be operably coupled with the valve body 70 and may move the valve body 70 between the at least two positions based on the rotation of the rotatable spray arm 34. The actuator 80 may be any suitable mechanism capable of moving the valve body 70 between the at least two positions based on the rotation of the rotatable spray arm 34. By way of a non-limiting example, the actuator 80 may include a drive system 82 operably coupled with the rotatable spray arm 34 and the valve body 70 such that rotation of the spray arm 34 moves the valve body 70 between the at least two positions. The drive system 82 has been illustrated as including a gear assembly 84 operably coupling the rotatable spray arm 34 and the valve body 70 such that rotation of the rotatable spray arm 34 moves the gear assembly 84 which in turn moves the slidable plate 72 between the at least two positions. Thus, the gear assembly 84 helps convert the rotational motion of the spray arm 34 into sliding motion for the slidable plate 72. The gear assembly 84 has been illustrated as including a gear chain having a first gear 85, second gear 86, third gear 87, fourth gear 88, and a fixed gear 89. A fixed shaft 90 may extend through a portion of the body 56 such that the rotatable spray arm 34 is rotationally mounted on the fixed shaft 90. Further, the fixed gear 89 may be fixedly mounted on the fixed shaft 90.

The drive system 82 further comprises a pin 92 operably coupled with and extending from an upper portion of the fourth gear 88 and received within a channel 94 located in the valve body 70 to operably couple the gear assembly 84 with the slidable plate 72. The channel 94 may be a depression in a bottom portion of the slidable plate 72 or as illustrated may be formed between two opposing walls 95, 96 extending downwardly from the bottom of the slidable plate 72.

A bracket 97 may be located within the interior 58 and houses at least a portion of the gear assembly 84 to provide support for the gear assembly 84. Portions of the gear assembly 84 may also be held within supports 98 formed by the body 56 of the spray arm assembly 34.

The operation of the dishwasher 10 with the described spray arm structure will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

Figure 3A:
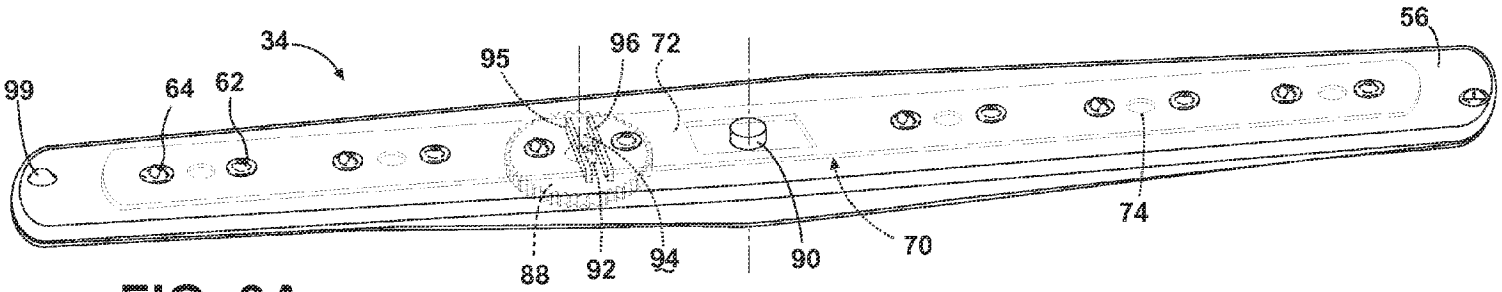
FIGS. 3A-3C are schematic views of the valve body in various positions within the rotatable spray arm of FIG. 2.

The lower rotatable spray arm 34 may rely on liquid pumped from the recirculation pump 46 to provide hydraulic drive to rotate the lower rotatable spray arm 34, which through the actuator 80 affects the movement of the valve body 70. More specifically, as illustrated in FIG. 3A, a hydraulic drive 99 may be formed by an outlet in the body 56 being oriented such that liquid emitted from the hydraulic drive outlet 99 effects the rotation of the lower rotatable spray arm 34. The lower rotatable spray arm 34 has been illustrated as having two hydraulic drive outlets 99 and these hydraulic drive outlets 99 are located such that when the recirculation pump 46 is activated, the lower rotatable spray arm 34 rotates regardless of the position of the valve body 70. It has also been contemplated that such hydraulic drive outlets 99 may be located on various portions of the body 56 including a side or bottom portion of the body 56. Alternatively, one or more of the multiple nozzles 62, 64 may form such hydraulic drive outlets.

As the lower rotatable spray arm 34 is hydraulically rotated about the fixed shaft 90, the first gear 85, which is mounted between the fixed gear 89 and the second gear 86, is rotatably mounted within the support 98, and moves with the rotation of the lower rotatable spray arm 34, may be driven around the fixed gear 89. Thus, the first gear 85 is also hydraulically driven and may be caused to circle about the fixed gear 89 as the lower rotatable spray arm 34 rotates about the fixed shaft 90. As the first gear 85 is driven about the fixed gear 89, it in turn causes the rotation of the second gear 86, the third gear 87, and the fourth gear 88.

Figure 3B:
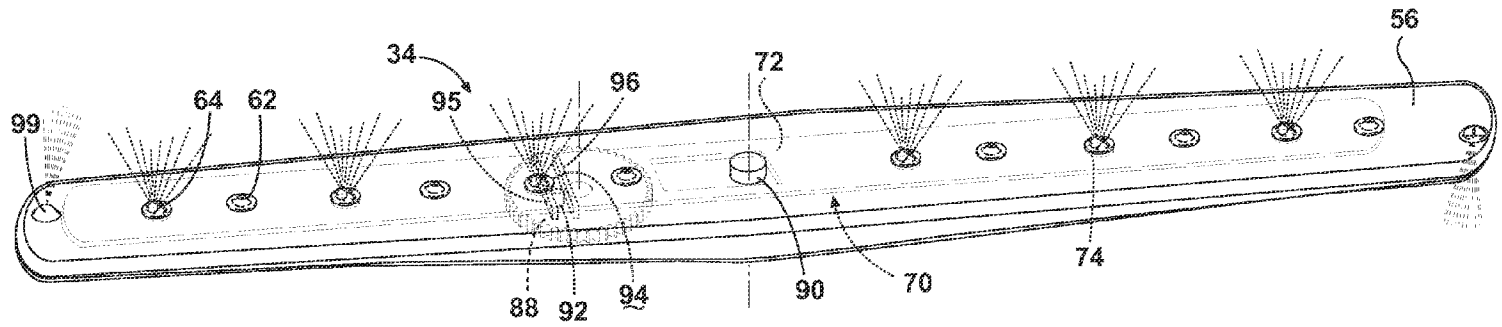
Figure 3C:
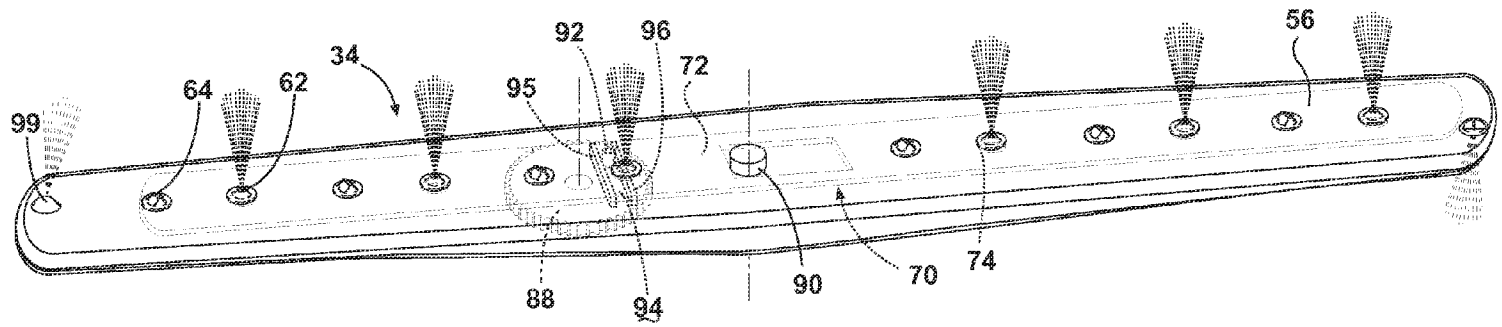

As the fourth gear 88 rotates, the pin 92 rotates within the interior 58 of the lower rotatable spray arm 34. As the pin 92 rotates, it moves within the boundaries of the channel 94 and causes the slidable plate 72 to be moved back and forth within the interior 58 of the lower rotatable spray arm 34. More specifically, as the pin 92 rotates with the fourth gear 88, the pin 92 pushes on the wall 95 for a first portion of a full rotation of the fourth gear 88 and pushes on the wall 96 for a second portion of the full rotation of the fourth gear 88. When the pin 92 pushes on the wall 95 it moves the slidable plate 72 to the first position illustrated in FIG. 3B. The slidable plate 72 may stay in the first position until the pin 92 is rotationally advanced to a point where it begins to push on the wall 96. When the pin 92 pushes on the wall 96 it moves the slidable plate 72 in the opposite direction until it reaches the second position illustrated in FIG. 3C. The slidable plate 72 may stay in the second position until the pin 92 is rotationally advanced to a point where it begins to again push on the wall 95. As the fourth gear 88 continues to rotate, the pin 92 continues to alternatively push against one of the walls 95 and 96 and continues to move the slidable plate 72 into the first and second positions. In this manner, the movement of the pin 92 within the channel 94 operably couples the gear assembly 84 to the slidable plate 72 such that the rotation of the gear assembly 84 may be converted into translational movement of the slidable plate 72. Essentially, the actuator 80 allows the valve body 70 to move between the at least two positions based on a rotational position of the rotatable spray arm 34.

As the slidable plate 72 moves side to side inside the lower rotatable spray arm 34, the valve body 70 closes the fluid path to one of the first and second subsets of outlets 60 and opens a fluid path to the other of the first and second subsets of outlets 60. More specifically, as the slidable plate 72 moves within the lower rotatable spray arm 34, the multiple openings 74 may align with either the first and second subset of outlets 60. When the slidable plate 72 is in the first position, the multiple openings 74 are aligned with the first subset of outlets 60 correlating to the multiple nozzles 62 and in the second position the multiple openings 74 are aligned with the second subset of outlets 60 correlating to the multiple nozzles 64. Thus, as the valve body 70 moves relative to the lower rotatable spray arm 34, each of the first and second subsets of outlets 60 are sequentially fluidly coupled and uncoupled as the lower rotatable spray arm 34 rotates.

It has been contemplated that the valve body 70 may have additional openings or alternative openings such that the second subset of the plurality of outlets which are fluidly coupled with the liquid passage may only differ from the first subset by one of the outlets. It has also been contemplated that when the valve body 70 is located intermediately of the first and second positions, water may be still be sprayed from the plurality of outlets 60 if at least a portion of the multiple openings fluidly couples a portion of the plurality of outlets 60. It has also been contemplated that the valve body 70 may be shaped such that there may be a point where the outlets in the valve body 70 do not allow for the fluid to enter any of the plurality of outlets 60 except for the hydraulic drive outlets 99.

The gear chain of the gear assembly 84 is illustrated as forming a reduction gear assembly. That is the valve body 70 is moved between the at least two positions by the actuator 80 over multiple rotations of the lower rotatable spray arm 34. As illustrated, the reduction gear assembly may provide a 40:1 gear reduction such that the valve body 70 will slide to the first and second positions over forty revolutions of the lower rotatable spray arm 34. The gear ratios of the gear assembly 84 may be selected to control the relative movement of the valve body 70 to the lower rotatable spray arm 34. The gear ratio of the gear assembly 84 is a function of the ratios of gears forming the gear assembly 84. Thus, the gears may be selected to provide a desired ratio to provide a desired fluid coupling time between the liquid passage 59 and the first and second subsets of outlets 60. The gear reduction ratio may also be selected to aid in allowing the hydraulic drive outlets 99 to overcome the friction created by the valve body 70.

As the rotatable spray arm 34 turns, the valve body 70 continues to move between the first and second positions and continues to selectively fluidly couple the first and second subsets of outlets 60. The amount of time that the multiple openings 74 are fluidly coupled with each of the first and second subsets of outlets 60 controls the duration of the time that each of the nozzles 62, 64 spray liquid. The time of fluid coupling may be thought of as a dwell time. With the above described valve body 70 and actuator 80, the dwell time may be controlled by the gear ratio, the spacing between the two opposing walls 95, 96 extending around the pin 92, and the flow rate of liquid. The movement of the lower rotatable spray arm 34 and the valve body 70 ends when fluid is no longer pumped by the recirculation pump 46 to the lower rotatable spray arm 34 such that the lower rotatable spray arm 34 is no longer hydraulically driven.

It has also been contemplated that a drive system may be included to control the rotation of the lower rotatable spray arm 34. Such a drive system may be motor-driven. For example, an electric motor (not shown) may be provided externally of the tub 18 and may be operably coupled to a portion of the lower rotatable spray arm 34 to rotate the lower rotatable spray arm 34. Such a motor-driven spray arm is set forth in detail in U.S. Pat. No. 8,113,222, filed Dec. 16, 2008, and titled "Dishwasher with Driven Spray Arm for Upper Rack" and U.S. Pat. No. 7,980,260, filed Apr. 16, 2010, and titled "Dishwasher with Driven Rotatable Spray Arm," which are incorporated herein by reference in their entirety. If the lower rotatable spray arm 34 is motor operated, the valve body 70 may be moved as the lower rotatable spray arm 34 rotates regardless of the flow rate provided by the recirculation pump 46. A motor driven lower rotatable spray arm 34 may be useful in instances where no hydraulic drive outlets are provided. Such a motor driven lower rotatable spray arm 34 may also allow for longer dwell times. In this manner, zonal washing, may be accomplished within the treating chamber 20 because the motor may have the ability to manipulate the speed of rotation of the lower rotatable spray arm 34 such that the controller 14 may control the spray emitted from the multiple nozzles 62 and 64 in pre-selected areas of the treating chamber 20.

Figure 4:
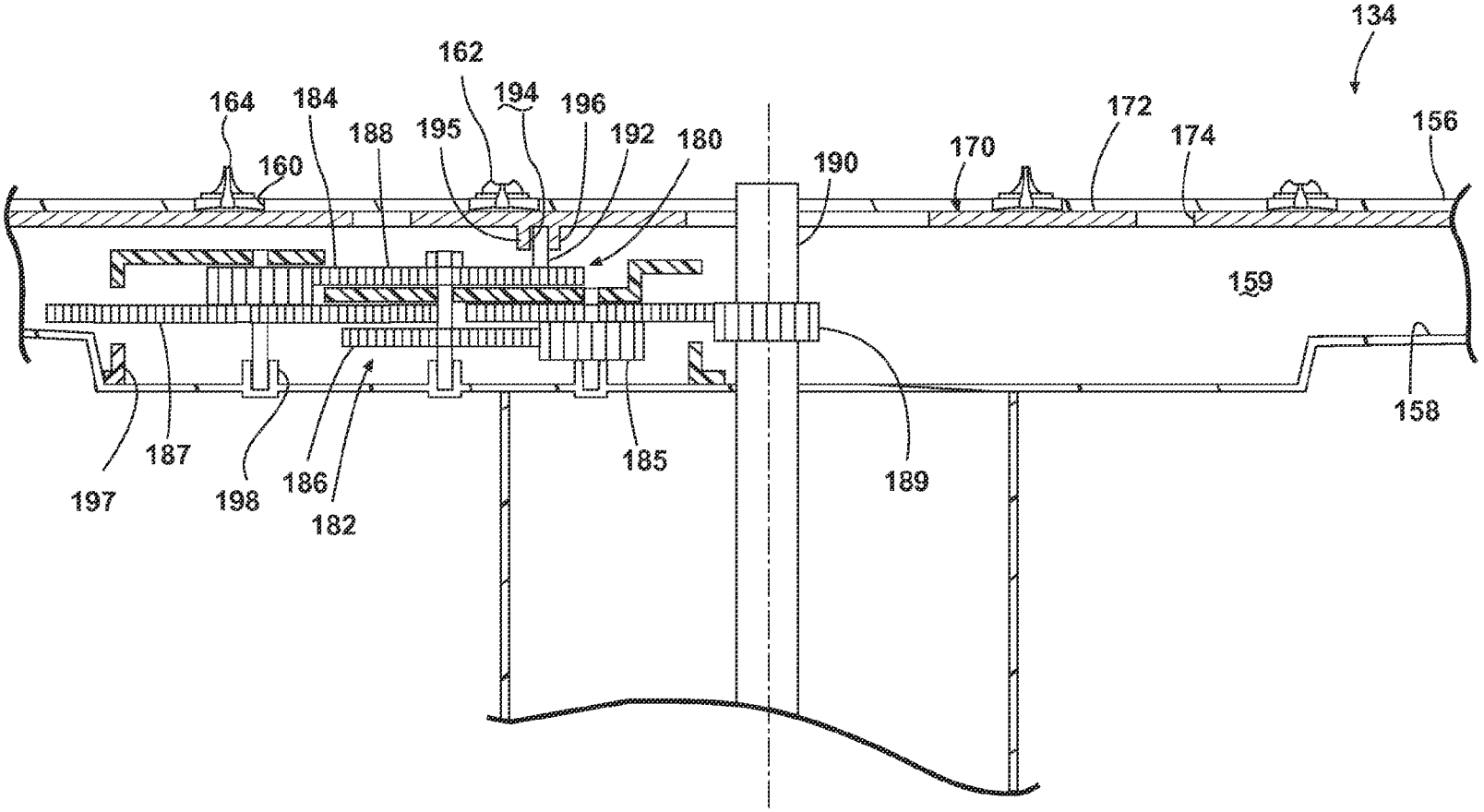
FIG. 4 is a cross-sectional view of a second embodiment of a lower spray arm, which may be used in the dishwasher of FIG. 1.

FIG. 4 illustrates a cross-sectional view of an alternative lower rotatable spray arm 134 according to a second embodiment of the invention. The lower rotatable spray arm 134 is similar to the lower rotatable spray arm 34 previously described and therefore, like parts will be identified with like numerals increased by 100, with it being understood that the description of the like parts of the lower rotatable spray arm 34 applies to the lower rotatable spray arm 134, unless otherwise noted.

The differences between the lower rotatable spray arm 34 and the lower rotatable spray arm 134 include that the lower rotatable spray arm 134 has been illustrated as having a lower profile body 156, an alternative gear assembly 184, and an alternative bracket 197, which is configured to accommodate the alternative gear assembly 184. During operation, the lower rotatable spray arm 134, valve body 170, and actuator 180 operate much the same as in the first embodiment wherein as the lower rotatable spray arm 134 is rotated, the gears in the gear assembly 184 are driven and the slidable plate 172 is moved between the first and second positions. However, the gear assembly 184 is configured to provide a larger gear reduction, namely a 73:1 gear reduction, such that the valve body 170 will slide to the first and second positions over 73 revolutions of the lower rotatable spray arm 134. Thus, the dwell time or fluid coupling time between the liquid passage 159 and the first and second subsets of outlets 160 is greater than in the first embodiment. Further, the lower profile body 156 may increase the space available in the treating chamber 20 for holding utensils to be treated.

Figure 5:
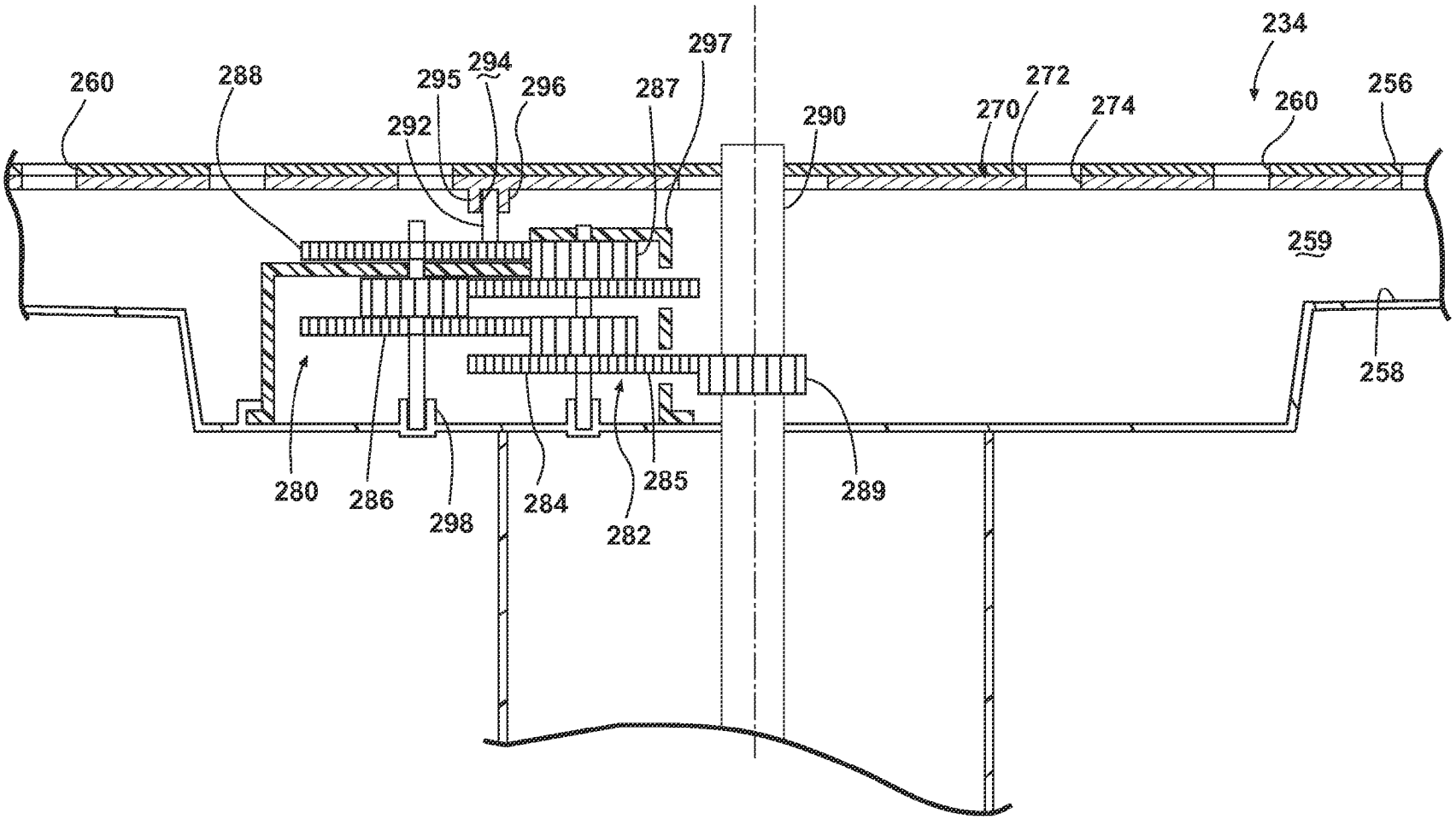
FIG. 5 is a cross-sectional view of a third embodiment of a lower spray arm, which may be used in the dishwasher of FIG. 1.

FIG. 5 illustrates a cross-sectional view of an alternative lower rotatable spray arm 234 according to a third embodiment of the invention. The lower rotatable spray arm 234 is similar to the lower rotatable spray arm 34 previously described and therefore, like parts will be identified with like numerals increased by 200, with it being understood that the description of the like parts of the lower rotatable spray arm 34 applies to the lower rotatable spray arm 234, unless otherwise noted.

One difference between the lower rotatable spray arm 34 and the lower rotatable spray arm 234 is that the plurality of outlets 260 form the nozzles for the spray arm 234 and no additional nozzle structures are provided on the body 256. Further, each of the outlets 260 is illustrated as having an identical configuration, such that there are no first and second subsets of outlets 260 as in the first embodiment. Alternatively however, the outlets 260 can be configured to provide different spray patterns, similar to the first embodiment. Another difference is that the slidable plate 272 of the valve body 270 has the same number of openings 274 as there are nozzle outlets 260. The slidable plate 272 may be slidably mounted within the interior 258 of the rotatable spray arm 234 for movement between at least two positions, and both positions may result in the multiple openings 274 being fluidly coupled with the multiple outlets 260. The valve body 270 may be formed such that the multiple openings 274 only partially close off a portion the outlet 260 as the slidable plate 272 is moved between the first and second positions. In this manner, each paired outlet 260 and opening 274 may collectively form an effective opening or nozzle, and the slidable plate 272 may move to adjust the relative positions of the outlets 260 and opening 274 to alter the shape of the effective nozzle to control the shape of the spray and direction of liquid emitted from the outlet 260.

Figure 6A:
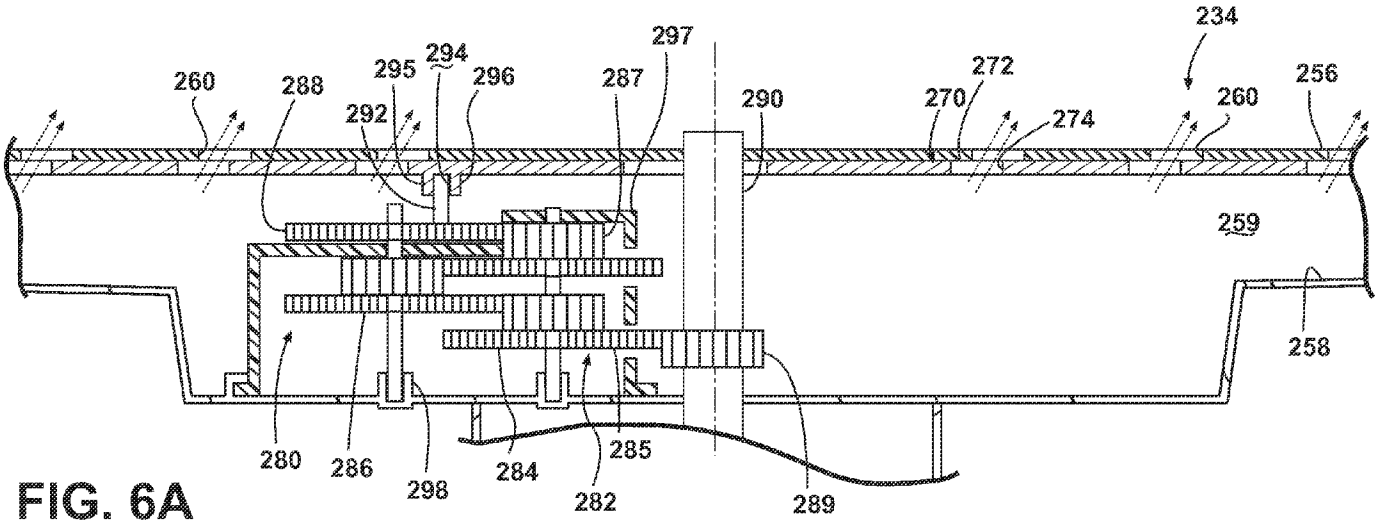
FIGS. 6A-6B are cross-sectional views of a valve body in various positions within the rotatable spray arm of FIG. 5.
Figure 6B:
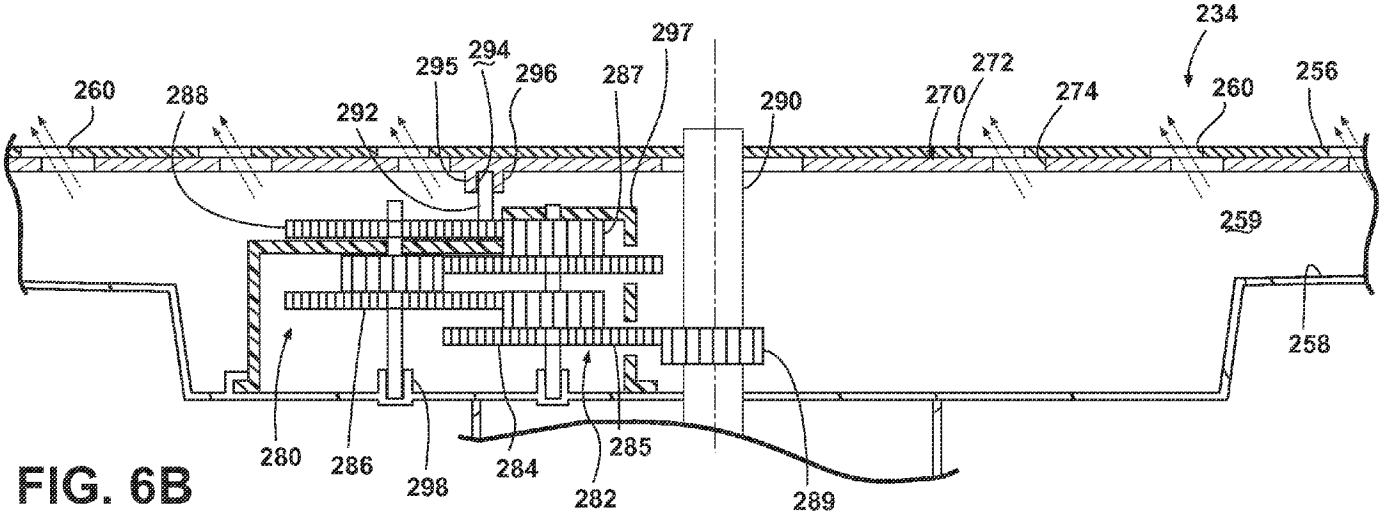

FIG. 6A illustrates a spray pattern that may be created when the slidable plate 272 is in the first position and FIG. 6B illustrates a spray pattern that may be created when the slidable plate 272 is in the second position. During operation, the lower rotatable spray arm 234, valve body 270, and actuator 280 operate much the same as in the first embodiment wherein as the lower rotatable spray arm 234 is rotated, the gears in the gear assembly 284 are driven and the slidable plate 272 is moved between the first and second positions. Alternatively, the rotatable spray arm 234 can be provided with a gear assembly similar to that of the second embodiment to achieve a higher gear reduction and longer dwell time.

As the slidable plate 272 is moved, the spray pattern from the outlets 260 is altered by the translation of the openings 274, which acts to change the flow of liquid from the outlet 260 by both reducing the size and changing the shape of the effective nozzle formed by the outlet 260 and opening 274. One result is that the direction of the liquid spraying from the outlets 260 is varied with the movement of the slidable plate 272. Such spraying is set forth in detail in the application Ser. No. 13/570,361 , filed concurrently herewith, and titled "Dishwasher with Spray System," which is incorporated herein by reference in its entirety.

Figure 7:
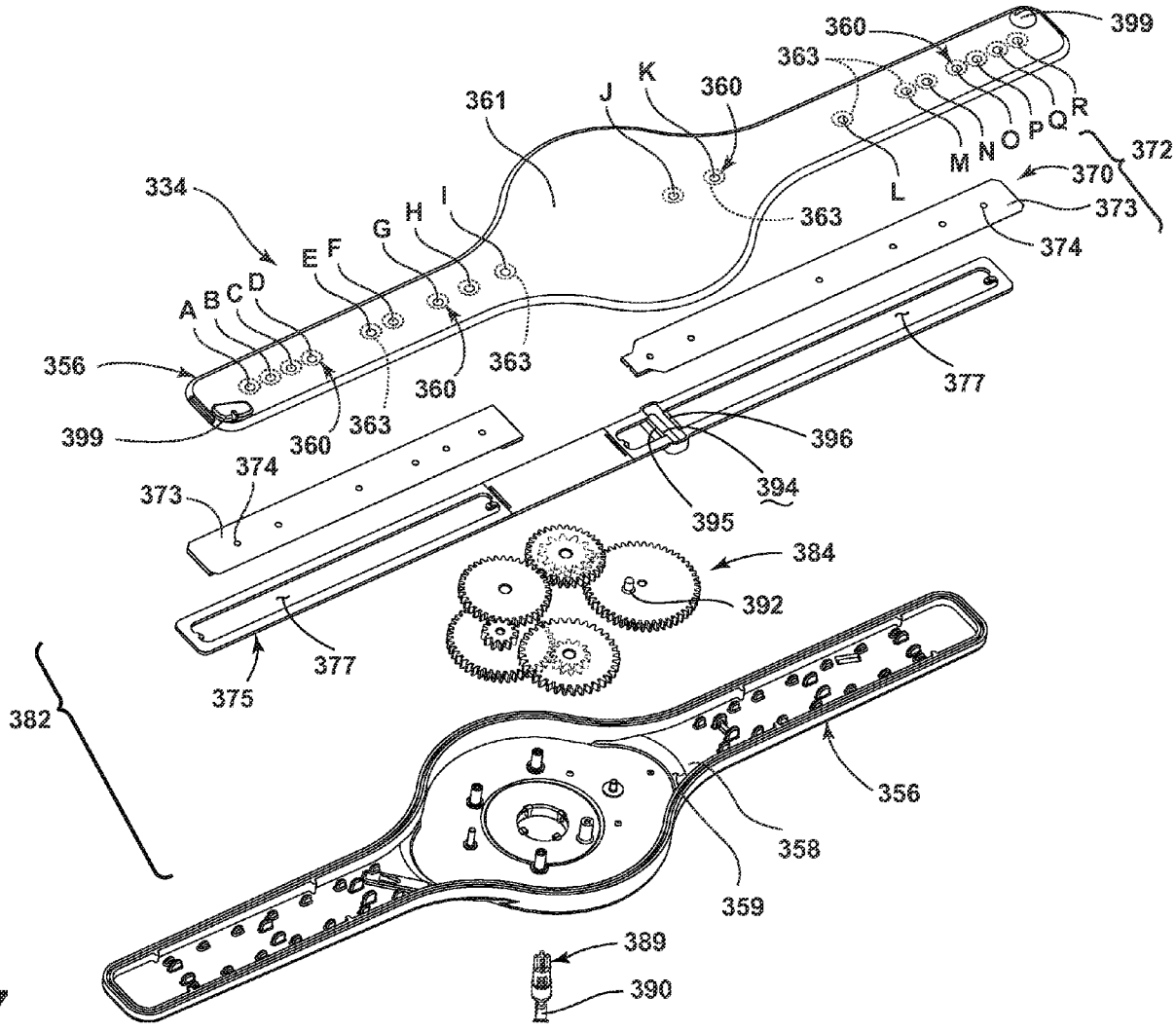
FIG. 7 is an exploded view of a fourth embodiment of a lower spray arm, which may be used in the dishwasher of FIG. 1.

While the valve body has been described and illustrated as a slidable plate in the embodiments above it is contemplated that the valve body may take any suitable form including that the slidable plate may take any suitable form. For example, the slidable plate may include a rigid plate, a flexible plate, or a thin film plate, which may be either flexible or rigid. Further, the valve body may include a moveable element and at least a portion may conform to the shape of the sprayer. FIG. 7 illustrates an alternative spray arm 334 and a valve body 370 according to a fourth embodiment of the invention. The spray arm 334 and valve body 370 are similar to the lower rotatable spray arm 34 and valve body 70 previously described and therefore, like parts will be identified with like numerals increased by 300, with it being understood that the description of the like parts applies to the fourth embodiment, unless otherwise noted.

As with the earlier embodiment, the spray arm 334 includes an interior 358 having at least one liquid passage 359, and at least one outlet 360 extending from the interior 358 to an exterior 361 of the spray arm 334 and in fluid communication with the liquid passage 359. In the illustrated example, there is a plurality of outlets 360. It should be noted that the outlets 360 may be spaced in any variety of suitable manners along the spray arm 334 including that the outlets 360 may be offset from each other.

One difference is that a plurality of sealing rings 363 are provided along the interior 358 of the body 356, with one of the sealing rings 363 surrounding each of the outlets 360. Such a sealing ring 363 may allow an opening 374 in the valve body 370 to fluidly couple with the outlet 360 so long as the opening 374 is at least partially within the sealing ring 363. In this manner, the sealing ring 363 creates a larger effective outlet and allows for a longer fluid communication between the outlet 360 having the sealing ring 363 and the opening 374 in the valve body 370. Such sealing rings are set forth in detail in the application Ser. No. 13/570,511, filed concurrently herewith, and titled "Dishwasher with Spray System," which is incorporated herein by reference in its entirety. The sealing ring 363 may be a raised ring surrounding the outlet 360 and may take any suitable form including that of an O-ring or other seal. Further, the sealing ring 363 may be a rib formed on an interior of the body of the spray arm 334. It is also contemplated that alternatively, the sealing ring could be included on the valve body 370 around an opening 374 and that this may also allow the opening 374 to fluidly couple with the outlet 360 so long as the outlet 360 is at least partially within the sealing ring surrounding the opening 374.

Another difference is that the slidable plate 372 is illustrated as including a frame 375 supporting a membrane 373. The membrane 373 may be supported or operably coupled to the frame 375 in any suitable manner. For example, the membrane 373 may be attached to the frame 375 of the slidable plate 372 at the ends of the membrane 373 to allow the membrane 373 to move and conform to the sealing rings 363. The membrane 373 may include one or more openings 374, which may be in fluid communication with the liquid passage 359. The slidable plate 372 may include open portions 377 to allow liquid to reach the membrane 373 from the liquid passage 359.

The membrane 373 has been illustrated as having multiple openings 374. The membrane 373 may be formed from any suitable material. For example, the membrane 373 may be formed from a flexible material such that it may conform to a shape of at least a portion of the spray arm 334 including the sealing rings 363 during use. The material may be able to withstand the high temperatures of the dishwasher 10 and the treating chemistry that is used in dishwasher 10. By way of further non-limiting example, the membrane 373 may be a 0.003 inch thick film of polyester.

Figure 8A:
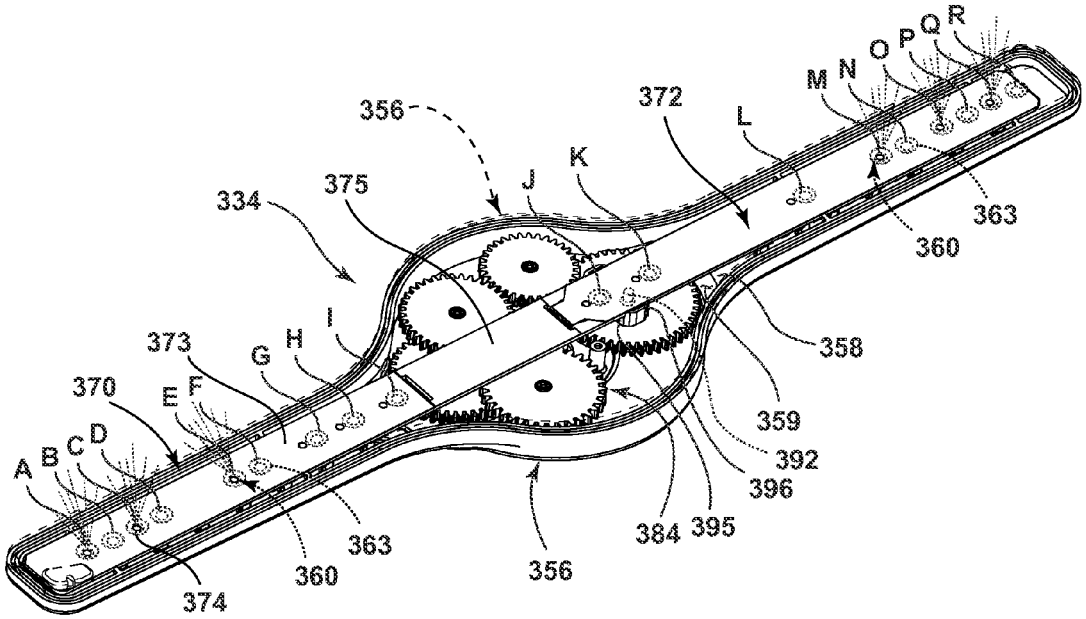
FIGS. 8A-8C are top views of the valve body in various positions within the rotatable spray arm of FIG. 7.

Referring now to FIG. 8A, the membrane 373 may be located within the interior 358 and may abut portions of the spray arm 334. Alternatively, the membrane 373 may be located outside the interior 358 of the spray arm 334 but still may be configured to conform to a shape of at least a portion of the spray arm 334. In the illustrated example, the membrane 373 is located between the liquid passage 359 and the outlets 360. In this manner, the membrane 373 may form a portion of the liquid passage 359 such as the upper extent of the liquid passage 359 as it abuts the lower surface of the top of the spray arm 334. The membrane 373 abuts the spray arm 334 to form a liquid seal between the spray arm 334 and the remainder of the liquid passage 359. The membrane 373 may be capable of sealing against the body 356 and/or the sealing rings 363 to better seal the outlets 360 against the unintended flow of liquid from the liquid passage 359.

The membrane 373 and the spray arm 334 may be coupled for relative movement such that one of the openings 374 passes over at least a portion of one of the outlets 360 to fluidly couple the liquid passage 359 to the outlet 360 and provide for the flow of liquid from the liquid passage 359, through the opening 374, and through the outlet 360 to emit a spray of liquid from the spray arm 334 into the treating chamber 20. This may be accomplished through a driver or driver system 382 operably coupled to at least one of the membrane 373 and the spray arm 334 to relatively move the membrane 373 and the spray arm 334. The driver system 382 may be configured as explained with respect to the embodiments above such that rotation of the spray arm 334 moves the valve body 370.

The drive system 382 has been illustrated as including a gear assembly 384 operably coupling the rotatable spray arm 334 and the valve body 370 such that rotation of the rotatable spray arm 334 moves the gear assembly 384 which in turn moves the slidable plate 372 between the at least two positions. More specifically, the gear assembly 384 helps convert the rotational motion of the spray arm 334 into sliding motion of a reciprocating driver that relatively reciprocates the membrane 373 and the spray arm 334. In the illustrated example, the reciprocating driver includes the frame 375. The drive system 382 may also include a pin 392 operably coupled with and extending from an upper portion of a gear of the gear assembly 384 and received within a channel 394 located in the frame 375 to operably couple the gear assembly 384 with the slidable plate 372. The channel 394 may be a depression in a bottom portion of the frame 375 or as illustrated may be formed between two opposing walls 395, 396 formed in the frame 375. The drive system 382 may reciprocate the membrane 373 relative to the rotating spray arm 334. Alternatively, the reciprocating driver may reciprocate the membrane 373 relative to the driver. For example, while the membrane 373 is illustrated as being used in conjunction with the frame 375, which supports the membrane 373, it is contemplated that the membrane 373 may be operably coupled to the drive system 382 without the use of the frame 375. It will be understood that any suitable drive assembly may be used to move the membrane 373. For example, a different gear assembly may be used to achieve a higher gear reduction and longer dwell time.

Figure 8B:
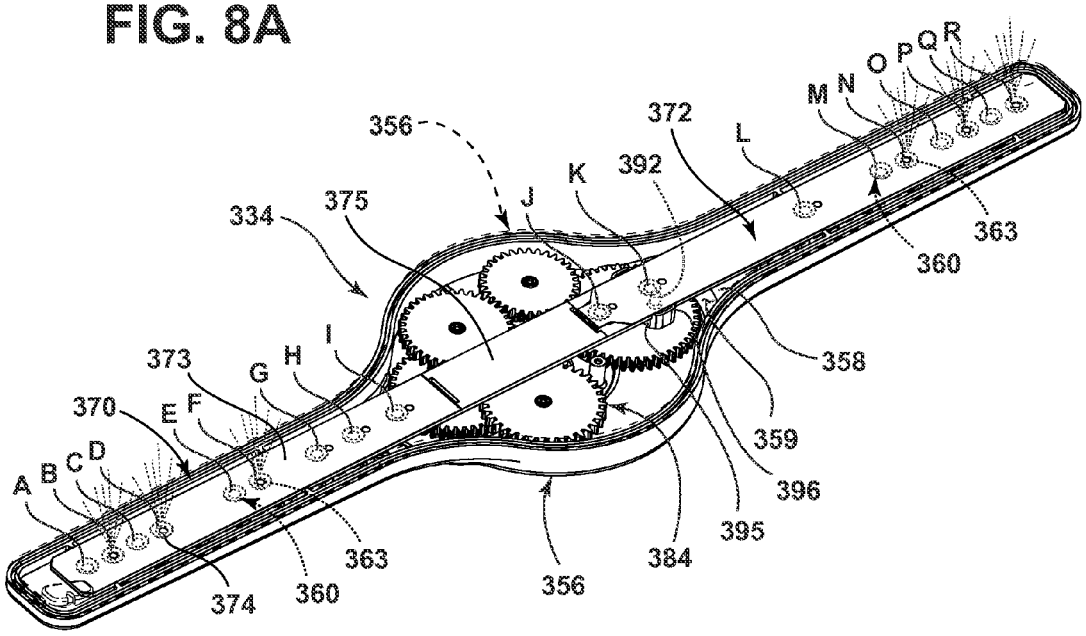
Figure 8C:
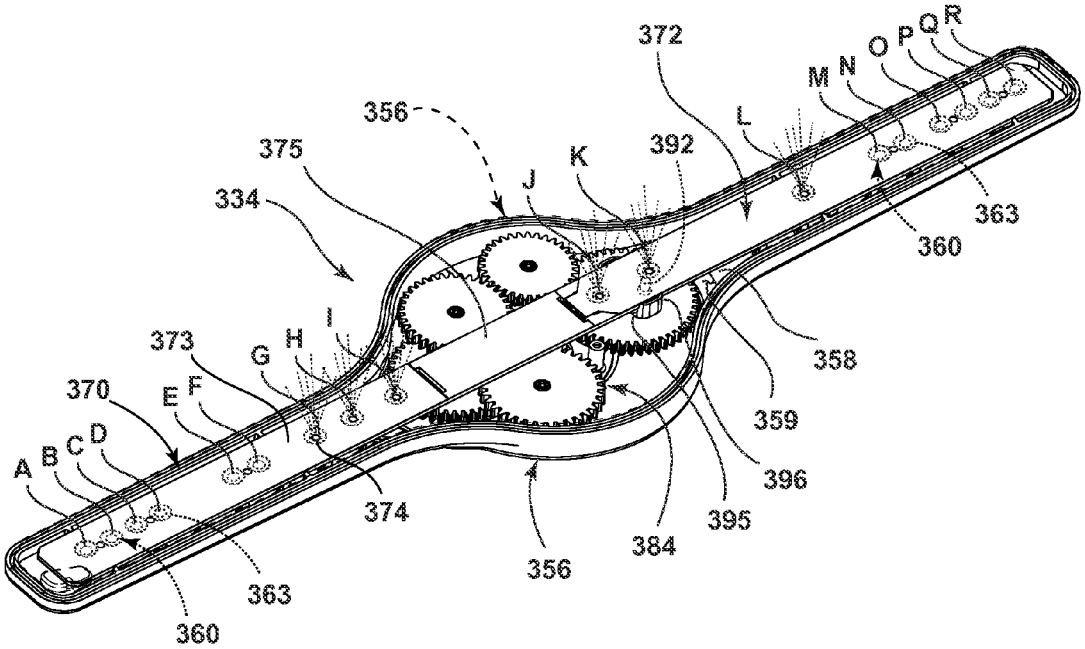

FIG. 8A illustrates the slidable plate 372 in a first position, FIG. 8B illustrates the slidable plate 372 in a second position, and FIG. 8C illustrates the slidable plate 372 in an intermediate position between the first and second positions. During operation, the spray arm 334 and drive system 382 operate much the same as in the first embodiment wherein as the spray arm 334 is rotated, gears in the drive system 382 are driven and the frame 375, to which the membrane 373 is mounted, is moved between the first, intermediate, and second positions. More specifically, as the pin 392 rotates, it moves within the boundaries of the channel 394 and causes the slidable plate 372 to be moved back and forth within the interior 358 of the spray arm 334.

In the illustrated example, the spray arm 334 includes multiple outlets 360 and the membrane 373 has multiple openings 374, which are fewer in number than the multiple outlets 360. Relative movement of the membrane 373 and spray arm 334 may selectively align the openings 374 with a subset of the multiple outlets 360. For example, the relative movement of the membrane 373 and spray arm 334 may selectively align an opening 374 between at least two of the multiple outlets 360. This may include the opening 374 being at least partially aligned with one of the multiple outlets. For example, a subset of the openings 374 may be spatially complementary with multiple subsets of the multiple outlets 360 such that the subset of openings 374 may align with one of the multiple subsets of the multiple outlets 360. This is the case as shown in FIGS. 8A and 8B. A first subset of the multiple outlets may be formed by the outlets denoted with the letters A, C, E, M, O, and Q. A second subset of the multiple outlets 360 may be formed by the outlets 360 denoted with the letters B, D, F, N, P, and R. The first and second subsets of the multiple outlets 360 use the same openings 374 in the membrane 373 to fluidly couple the outlets 360 to the liquid passage 359 depending upon which position the membrane 373 is in. Referring now to FIG. 8C, when the membrane 373 is moved to the intermediate position of the slidable plate 372 a third subset of the multiple outlets 360 denoted by the letters G, H, I, J, K, and L are coupled with openings 374 in the membrane 373. In the intermediate position other openings 374 in the membrane 373 are utilized as compared to when the membrane is in either of the first or second positions.

Figure 9:
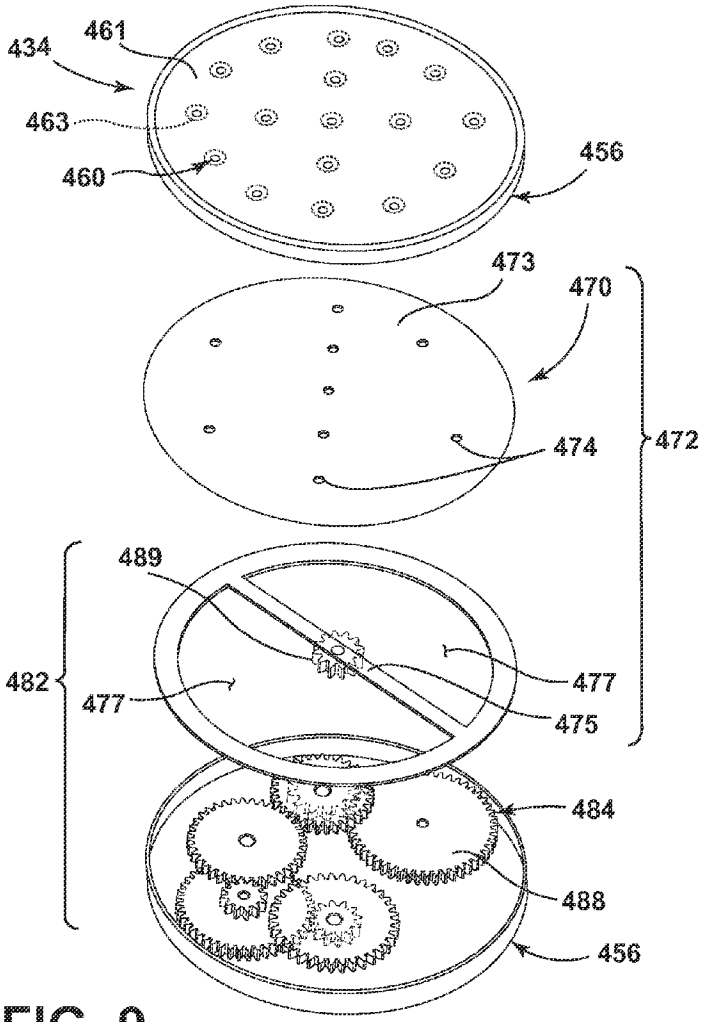
FIG. 9 is an exploded view of a fifth embodiment of a sprayer, which may be used in the dishwasher of FIG. 1.

While the relative movement of the membrane 373 and the spray arm 334 has been described as translational movement it is contemplated that the relative movement may be any suitable movement including rotational movement. Further still, while the sprayer has been illustrated and described as a rotatable spray arm it will be understood that any suitable sprayer may be used in any of the above embodiments. For example, a non-rotatable spray arm may be used and the actuator may move the valve body within the spray arm. Further, a sprayer having a different shape may be used and may be either rotatable or non-rotatable. FIG. 9 illustrates an alternative sprayer 434 and a membrane 473 according to a fifth embodiment of the invention. The sprayer 434 and membrane 473 are similar to the spray arm 334 and membrane 373 previously described and therefore, like parts will be identified with like numerals increased by 100, with it being understood that the description of the like parts applies to the fourth embodiment, unless otherwise noted.

One difference is that the sprayer 434 includes a disk 461. In the illustrated example, the membrane 473 is circular and has multiple openings 474, which are fewer in number than the multiple outlets 460 of the disk 461. Another difference is that the driver or drive system 482 includes a rotating driver or rotating plate 472 that relatively rotates the membrane 473 and the sprayer 434. The membrane 473 may be operably coupled to the body 475 of the rotating plate 472 to allow the membrane 473 to be moved with the rotating plate 472 while still allowing the membrane 473 to move and conform to the sealing rings 463. The rotating plate 472 may include open portions 477 to allow liquid to reach the membrane 473 from the liquid passage 459. The disk 461 may be stationary or rotatable. If the disk 461 is rotatable it may be either hydraulically or motor driven.

The drive system 482 has been illustrated as including a gear assembly 484 operably coupling the rotatable sprayer 434 and the membrane 473 such that rotation of the rotatable sprayer 434 moves the gear assembly 484 which in turn moves the rotating plate 472 and the membrane 473. The gear assembly 484 helps convert the rotational motion of the sprayer 434 into rotational motion of the rotating plate 472. The drive system 482 may be any suitable drive system including that the gear assembly 484 may be much like the gear assemblies described above. In the case where the disk 461 is stationary and hydraulic movement does not provide a mechanism for driving the drive system 482 it is contemplated that an input to the drive system 482 may include output from a motor operably coupled to the controller 14. Another difference is that in the illustrated example instead of including a pin that engages the plate, the gear assembly 484 includes a gear 488, which may be operably coupled to an input gear 489. The input gear 489 may be operably coupled to the rotating plate 472 such that the rotating plate 472 may be rotated through input to the input gear 489 from the gear 488.

Figure 10:
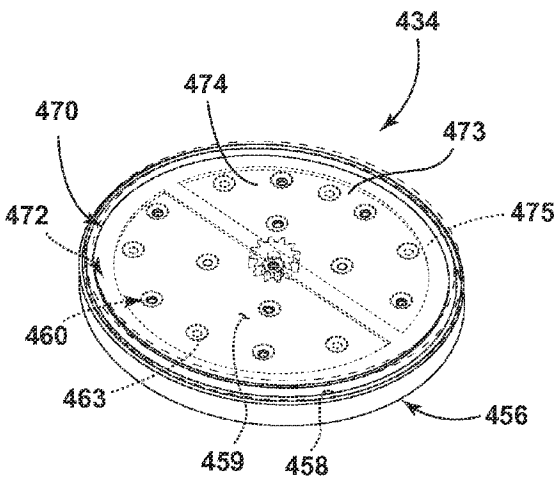
FIG. 10 is a top view of the sprayer of FIG. 9.

Referring now to FIG. 10, the membrane 473 may be located within the interior 458 of the disk 461 such that it is located between the liquid passage and the outlets 460. The membrane 473 abuts the sprayer 434 to form a liquid seal between the sprayer 434 and the remainder of the liquid passage 459. The membrane 473 may be capable of sealing against the body 456 and/or the sealing rings 463 to better seal the outlets 460 against the unintended flow of liquid from the liquid passage 459.

The membrane 473 and the sprayer 434 may be coupled for relative movement such that one of the openings 474 passes over at least a portion of one of the outlets 460 to fluidly couple the liquid passage 459 to the outlet 460 and provide for the flow of liquid from the liquid passage 459, through the opening 474, and through the outlet 460 to emit a spray of liquid from the sprayer 434 into the treating chamber 20. More specifically, the rotating driver rotates the membrane 473 relative to the disk 461. As with the earlier embodiment relative movement of the membrane 473 and sprayer 434 may selectively align an opening 474 in the membrane 473 between at least two of the multiple outlets 460. In the illustrated example, relative movement of the membrane 473 and sprayer 434 selectively aligns the openings 474 with a subset of the multiple outlets 460.

There are several advantages of the present disclosure arising from the various features of the apparatuses described herein. For example, the embodiments described above allow for additional coverage of the treating chamber 20 with multiple spray patterns. The first and second embodiments allow for multiple types of spray nozzles having multiple spray patterns, which may be used during a cycle of operation, which in turn may result in better cleaning of utensils within the treating chamber 20 with no additional liquid consumption. Further, because the lower rotatable sprayers have multiple subsets of outlets and each multiple subset has a smaller total nozzle area than current spray arm designs, lower flow rates may be used and this may result in less liquid or water being required. This may increase the velocity of the spray emitted from each of the first and second subsets of nozzles while not sacrificing coverage or individual nozzle size. Further, with less liquid flow needed, a smaller recirculation pump having a smaller motor may also be used which may result in a cost and energy savings. The third embodiment described above allows for a single type of nozzle which emits varying spray patterns, including sprays in different directions and having different intensities, which may result in additional coverage of the treating chamber 20 and better cleaning of utensils within the treating chamber 20 with no additional liquid consumption. The fourth and fifth embodiment, which include the membrane, allow for the outlets to be sealed such that liquid does not leak to outlets that are not intentionally being fluidly coupled with the fluid passage. Such sealing challenges may occur for various reasons including because the surface of the valve body or the sprayer are too rough or uneven. The sealing rings provide a smaller sealing surface for the membrane allowing a greater force to be applied to those points and allowing for a better seal. The sealing rings also allows soils, which may pass into the sprayer, to pass under the membrane without running the risk of holding the membrane up, providing a leak path. The flex in the membrane allows it to form around the sealing ring and provide a robust seal.

While the invention has been specifically described in connection with certain specific embodiments thereof, it is to be understood that this is by way of illustration and not of limitation. For example, it has been contemplated that the valve body and actuator may be located in other rotatable spray arms such as a mid-level rotatable spray arm. Further, other actuators may be used to control the movement of the valve body based on the rotation of the lower rotatable spray arm and the illustrated actuators including gear assemblies are merely exemplary. Further, although both gear assemblies illustrated include the same number of gears, it has been contemplated that the gear assembly may include any number of gears. Further, even though the gear assemblies are shown in a stacked configuration they could organized in a more horizontal layout. Further, while the valve body has been illustrated and described as moving in a linear motion it is contemplated that the valve body may alternatively be moved in an orbital motion. Such a motion could be created in a variety of ways including, by way of non-limiting example, replacing the pin described above with a pivot pin, which is mounted to the valve body slightly off center of the final gear, which would allow the plate to orbit. Alternatively, one end of the valve body may have a pin in a short longitudinal slot defining one end, while the other end orbits. As yet another non-limiting alternative, an additional gear may be added in the same plane as the fourth gear and may be of the same size and thus rotate at a synchronized speed with the fourth gear. A pin may be included on this additional gear and may orbit in unison with and retain a constant distance from the other pin. Since the valve plate is engaged to both pins the entire plate would be caused to orbit. With the valve body, or a portion of the valve body, capable of orbital motion the multiple openings may be dispersed in a two-dimension plane in a wider variety of ways such that the outlets could be changed when the valve body orbits. Further, the valve body could be made to orbit around the multiple openings to allow for sprays in all directions. Further, while the embodiments with the membranes have been described with respect to the membrane being moved relative to the sprayer or spray arm it will be understood that alternatively the sprayer or spray arm may be moved relative to the membrane to accomplish the desired fluid couplings.

The patentable scope of the invention is defined by the claims, and may include other examples that occur to those skilled in the art. It will be understood that any features of the above described embodiments may be combined in any manner. Reasonable variation and modification are possible within the scope of the forgoing disclosure and drawings without departing from the spirit of the invention which is defined in the appended claims.

What is claimed is:

1. A dishwasher for treating utensils according to an automatic cycle of operation, comprising:

a tub at least partially defining a treating chamber for receiving utensils for treatment according to the automatic cycle of operation;

a sprayer for spraying liquid into the treating chamber and defining an interior having at least one liquid passage, and at least one outlet extending from the interior to an exterior of the sprayer and in fluid communication with the liquid passage;

at least one sealing ring provided along the interior of the sprayer and including a raised O-ring surrounding the at least one outlet; and a flexible film having at least one opening, and in fluid communication with the liquid passage;

wherein the flexible film and the sprayer are operably coupled wherein, during use, the flexible film conforms to and moves relative to the raised O-ring provided on the sprayer to form a liquid seal between the at least one sealing ring and the flexible film, and such that rotation of the sprayer causes reciprocating movement of the flexible film relative to the sprayer such that the at least one opening passes over at least a portion of the at least one outlet to fluidly couple the liquid passage to the outlet and provide for a flow of liquid from the liquid passage, through the at least one opening, and through the outlet to emit a spray of liquid from the sprayer into the treating chamber.

2. The dishwasher of claim 1, further comprising a driver operably coupled to at least one of the flexible film and the sprayer to relatively move the flexible film and sprayer.

3. The dishwasher of claim 2 wherein the driver comprises a reciprocating driver that relatively reciprocates the flexible film and the sprayer.

4. The dishwasher of claim 3 wherein the reciprocating driver reciprocates the flexible film relative to the driver.

5. The dishwasher of claim 2 wherein the driver comprises a rotating driver that relatively rotates the flexible film and the sprayer.

6. The dishwasher of claim 5 wherein the sprayer comprises a disk and the rotating driver relatively rotates the flexible film and disk.

7. The dishwasher of claim 6 wherein the rotating driver rotates the flexible film relative to the disk.

8. A dishwasher for treating utensils according to an automatic cycle of operation, comprising:

a tub at least partially defining a treating chamber for receiving utensils for treatment according to the automatic cycle of operation;

a rotating spray arm for spraying liquid into the treating chamber and defining an interior having at least one liquid passage, and at least one outlet extending from the interior to an exterior of the spray arm and in fluid communication with the liquid passage;

a flexible membrane located within the interior and having at least one opening, and in fluid communication with the liquid passage; and a driver including a gear train operably coupled to the flexible membrane and the rotating spray arm to laterally reciprocate the flexible membrane laterally within the rotating spray arm based on rotation of the rotating spray arm to define a relative movement;

wherein, during use, the flexible membrane conforms to a shape of a portion of the spray arm, and as the flexible membrane is laterally reciprocated the at least one opening passes over at least a portion of the at least one outlet to fluidly couple the liquid passage to the outlet and provide for a flow of liquid from the liquid passage, through the at least one opening, and through the outlet to emit a spray of liquid from the spray arm into the treating chamber.

9. The dishwasher of claim 8 wherein the flexible membrane abuts the spray arm.

10. The dishwasher of claim 9 wherein the flexible membrane is located between the liquid passage and the at least one outlet.

11. The dishwasher of claim 10 wherein the flexible membrane forms a portion of the liquid passage.

12. The dishwasher of claim 10 wherein the flexible membrane abuts the portion of the spray arm to form a liquid seal between the portion of the spray arm and the liquid passage.

13. The dishwasher of claim 12 wherein the at least one outlet comprises a plurality of outlets.

14. The dishwasher of claim 13, further comprising a seal surrounding each of the outlets.

15. The dishwasher of claim 8 wherein the spray arm comprises multiple outlets and the relative movement of the flexible membrane and spray arm selectively aligns the at least one opening between at least two of the multiple outlets.

16. The dishwasher of claim 15 wherein the flexible membrane has multiple openings, which are fewer in number than the multiple outlets, wherein relative movement of the flexible membrane and the spray arm selectively aligns the multiple openings with a subset of the multiple outlets.

17. The dishwasher of claim 16 wherein a subset of the multiple openings are spatially complementary with multiple subsets of the multiple outlets, wherein relative movement of the flexible membrane and the spray arm selectively aligns the subset of the multiple openings with one of the multiple subsets of the multiple outlets.

* * * * *